US010902812B2

(12) United States Patent
Lee

(10) Patent No.: US 10,902,812 B2
(45) Date of Patent: Jan. 26, 2021

(54) DISPLAY APPARATUS HAVING COMPENSATED GATE CLOCK SIGNAL AND METHOD OF DRIVING THE SAME

(71) Applicant: Samsung Display Co., Ltd., Yongin-Si (KR)

(72) Inventor: Chang-Soo Lee, Suwon-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 139 days.

(21) Appl. No.: 16/028,650

(22) Filed: Jul. 6, 2018

(65) Prior Publication Data

US 2019/0027109 A1 Jan. 24, 2019

(30) Foreign Application Priority Data

Jul. 21, 2017 (KR) ..... 10-2017-0093020

(51) Int. Cl.
*G09G 5/00* (2006.01)
*G09G 3/36* (2006.01)

(52) U.S. Cl.
CPC ..... *G09G 3/3677* (2013.01); *G09G 3/3688* (2013.01); *G09G 2310/0289* (2013.01); *G09G 2310/08* (2013.01)

(58) Field of Classification Search
CPC ..... G09G 3/3677; G09G 3/3688; G09G 2310/08; G09G 2310/0289
USPC ..... 345/208
See application file for complete search history.

(56) References Cited

U.S. PATENT DOCUMENTS

2004/0041774 A1* 3/2004 Moon ..... G09G 3/3677 345/99
2006/0001631 A1 1/2006 Yamazaki
2007/0159438 A1* 7/2007 Cho ..... G09G 3/3648 345/98
2007/0296682 A1* 12/2007 Hwang ..... G09G 3/3677 345/100
2008/0117157 A1* 5/2008 Hwang ..... G09G 3/3611 345/92
2008/0238844 A1* 10/2008 Kakiuchi ..... G09G 3/3611 345/87
2010/0066708 A1* 3/2010 Kim ..... G09G 3/3614 345/204

(Continued)

FOREIGN PATENT DOCUMENTS

KR 20070079489 A * 8/2007 ..... G09G 3/36
KR 1020170038304 A 4/2017

*Primary Examiner* — Adam J Snyder
(74) *Attorney, Agent, or Firm* — Cantor Colburn LLP

(57) ABSTRACT

A display apparatus includes a display panel displaying an image and including a gate line and a data line, a gate driver outputting a gate signal to the gate line, a data driver outputting a data signal to the data line, a timing controller outputting a vertical start signal and a gate clock, and a gate clock signal compensator generating an inner clock signal based on the vertical start signal, selecting one of the gate clock signal and the inner clock signal based on a comparison result of a time difference between the gate clock signal and the inner clock signal and a reference time which corresponds to tolerance of jitter of the gate clock signal, increasing a level of the selected clock signal, and outputting the increased clock signal to the gate driver, where the gate driver generates the gate signal based on the increased clock signal.

13 Claims, 9 Drawing Sheets

(56) References Cited

U.S. PATENT DOCUMENTS

2011/0279424 A1* 11/2011 Lin ..... G09G 5/008
345/205
2014/0028639 A1* 1/2014 Kim ..... G09G 3/20
345/204

* cited by examiner

DISPLAY APPARATUS HAVING COMPENSATED GATE CLOCK SIGNAL AND METHOD OF DRIVING THE SAME

This application claims priority to Korean Patent Application No. 10-2017-0093020, filed on Jul. 21, 2017, and all the benefits accruing therefrom under 35 U.S.C. § 119, the content of which in its entirety is herein incorporated by reference.

BACKGROUND

1. Field

Exemplary embodiments of the invention relate to displaying an image. More particularly, exemplary embodiments of the invention relate to a display apparatus and a method of driving the display apparatus.

2. Description of the Related Art

A display apparatus includes a display panel and a display panel driver.

The display panel in general includes a gate line, a data line and a pixel defined by the gate line and the data line. If the display panel is a liquid crystal display panel, the pixel may include a thin film transistor, a liquid crystal capacitor and a storage capacitor. The thin film transistor is electrically connected to the gate line and the data line. The liquid crystal capacitor and the storage capacitor are electrically connected to the thin film transistor.

The display panel driver in general includes a gate driver, a data driver and a timing controller. The gate driver outputs a gate signal to the gate line. The data driver outputs a data signal to the data line. The timing controller may output a gate clock signal to the gate driver to control a timing of the gate driver. The timing controller may output a data clock signal to the data driver to control a timing of the data driver.

SUMMARY

When the gate clock signal has time differences in frames which is called a jitter, the display panel may display a horizontal line defect. Thus, when the gate clock signal has a jitter, the display quality of the display apparatus may be deteriorated.

Exemplary embodiments of the invention provide a display apparatus to enhance a display quality of the display apparatus.

Exemplary embodiments of the invention also provide a method of driving the above-mentioned display apparatus.

According to an exemplary embodiment of the invention, a display apparatus includes a display panel which displays an image and includes a gate line and a data line, a gate driver which outputs a gate signal to the gate line, a data driver which outputs a data signal to the data line, a timing controller which outputs a vertical start signal and a gate clock signal, and a gate clock signal compensator which generates an inner clock signal based on the vertical start signal, selects one of the gate clock signal and the inner clock signal based on a comparison result of a time difference between the gate clock signal and the inner clock signal and a reference time which corresponds to tolerance of jitter of the gate clock signal, increases a level of the selected one of the gate clock signal and the inner clock signal, and outputs the increased one of the gate clock signal and the inner clock signal to the gate driver as a compensated gate clock signal, where the gate driver generates the gate signal based on the compensated gate clock signal.

In an exemplary embodiment, when the time difference between the gate clock signal and the inner clock signal is equal to or greater than the reference time, the gate clock signal compensator may select the inner clock signal of the gate clock signal and the inner clock signal.

In an exemplary embodiment, the gate clock signal compensator may include a lookup table part which stores the reference time.

In an exemplary embodiment, the gate clock signal compensator may include a lookup table part which stores periodic data for an inner clock base signal which is a base signal of the inner clock signal.

In an exemplary embodiment, the gate clock signal compensator may further include a signal generator which generates the inner clock base signal based on the vertical start signal and the periodic data for the inner clock base signal.

In an exemplary embodiment, the periodic data for the inner clock base signal may include data regarding a first period, a second period and a third period. The first period may be from a time of a rising edge of the vertical start signal to a time of a rising edge of the inner clock base signal. The second period may be from a time of the rising edge of the inner clock base signal to a time of a falling edge of the inner clock base signal. The third period may be from a time of the falling edge of the inner clock base signal to a time of a next rising edge of the inner clock base signal.

In an exemplary embodiment, the gate clock signal compensator may include a clock signal generator which generates the inner clock signal in response to a rising edge of an inner clock base signal which is a base signal of the inner clock signal.

In an exemplary embodiment, the gate clock signal compensator may include a comparator which compares the gate clock signal and the inner clock signal, and compares the time difference between the gate clock signal and the inner clock signal to the reference time.

In an exemplary embodiment, when the time difference between the gate clock signal and the inner clock signal is less than the reference time, the gate clock signal compensator may select the gate clock signal of the gate clock signal and the inner clock signal.

In an exemplary embodiment, the display apparatus may further include a voltage manager which outputs a driving voltage to the data driver. The gate clock signal compensator may be included in the voltage manager.

In an exemplary embodiment, the display panel may be a liquid crystal display panel including a liquid crystal layer. The voltage manager may output a common voltage to the display panel.

According to an exemplary embodiment of the invention, a display apparatus includes a display panel which displays an image and includes a gate line and a data line, a gate driver which outputs a gate signal to the gate line, a data driver which outputs a data signal to the data line, a timing controller which outputs a vertical start signal, and a gate clock signal compensator which generates an inner clock signal based on the vertical start signal, increases a level of the inner clock signal, and outputs the increased clock signal to the gate driver as a compensated gate clock signal, where the gate driver generates the gate signal based on the compensated gate clock signal.

In an exemplary embodiment, the gate clock signal compensator may include a lookup table part which stores periodic data for an inner clock base signal which is a base signal of the inner clock signal.

In an exemplary embodiment, the gate clock signal compensator may further include a signal generator which generates the inner clock base signal based on the vertical start signal and the periodic data for the inner clock base signal.

In an exemplary embodiment, the periodic data for the inner clock base signal includes data regarding a first period, a second period and a third period. The first period may be from a time of a rising edge of the vertical start signal to a time of a rising edge of the inner clock base signal. The second period may be from a time of the rising edge of the inner clock base signal to a time of a falling edge of the inner clock base signal. The third period may be from a time of the falling edge of the inner clock base signal to a time of a next rising edge of the inner clock base signal.

In an exemplary embodiment, the gate clock signal compensator may include a clock signal generator which generates the inner clock signal in response to a rising edge of an inner clock base signal which is a base signal of the inner clock signal.

In an exemplary embodiment, the display apparatus may further include a voltage manager which outputs a driving voltage to the data driver. The gate clock signal compensator may be included in the voltage manager.

In an exemplary embodiment, the display panel may be a liquid crystal display panel including a liquid crystal layer. The voltage manager may output a common voltage to the display panel.

According to an exemplary embodiment the invention, a method includes generating an inner clock base signal based on a vertical start signal and periodic data for the inner clock base signal, generating an inner clock signal based on the inner clock base signal, determining whether a time difference between a gate clock signal and the inner clock signal is equal to or greater than a reference time which corresponds to tolerance of jitter of the gate clock signal, selecting the inner clock signal of the gate clock signal and the inner clock signal as a selected clock signal when the time difference between the gate clock signal and the inner clock signal is equal to or greater than the reference time, selecting the gate clock signal of the gate clock signal and the clock signal as the selected clock signal when the time difference between the gate clock signal and the inner clock signal is less than the reference time, increasing a level of the selected clock signal, providing the selected clock signal having the increased level as a compensated gate clock signal, generating a gate signal based on the compensated gate clock signal, providing the gate signal to a gate line of a display panel and providing a data signal to a data line of the display panel.

According to exemplary embodiments of the display apparatus and the method of driving the display apparatus of the invention, the jitter in the gate clock signal is compensated and the compensated gate clock signal is outputted. In addition, the gate signals are generated based on the compensated gate clock signal that the jitter of the gate clock signal is compensated. Thus, the horizontal line defect due to the jitter may be effectively prevented. Therefore, the display quality of the display apparatus may be enhanced.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Hereinafter, the invention will be explained in detail with reference to the accompanying drawings.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary Embodiment 1

Figure 1:
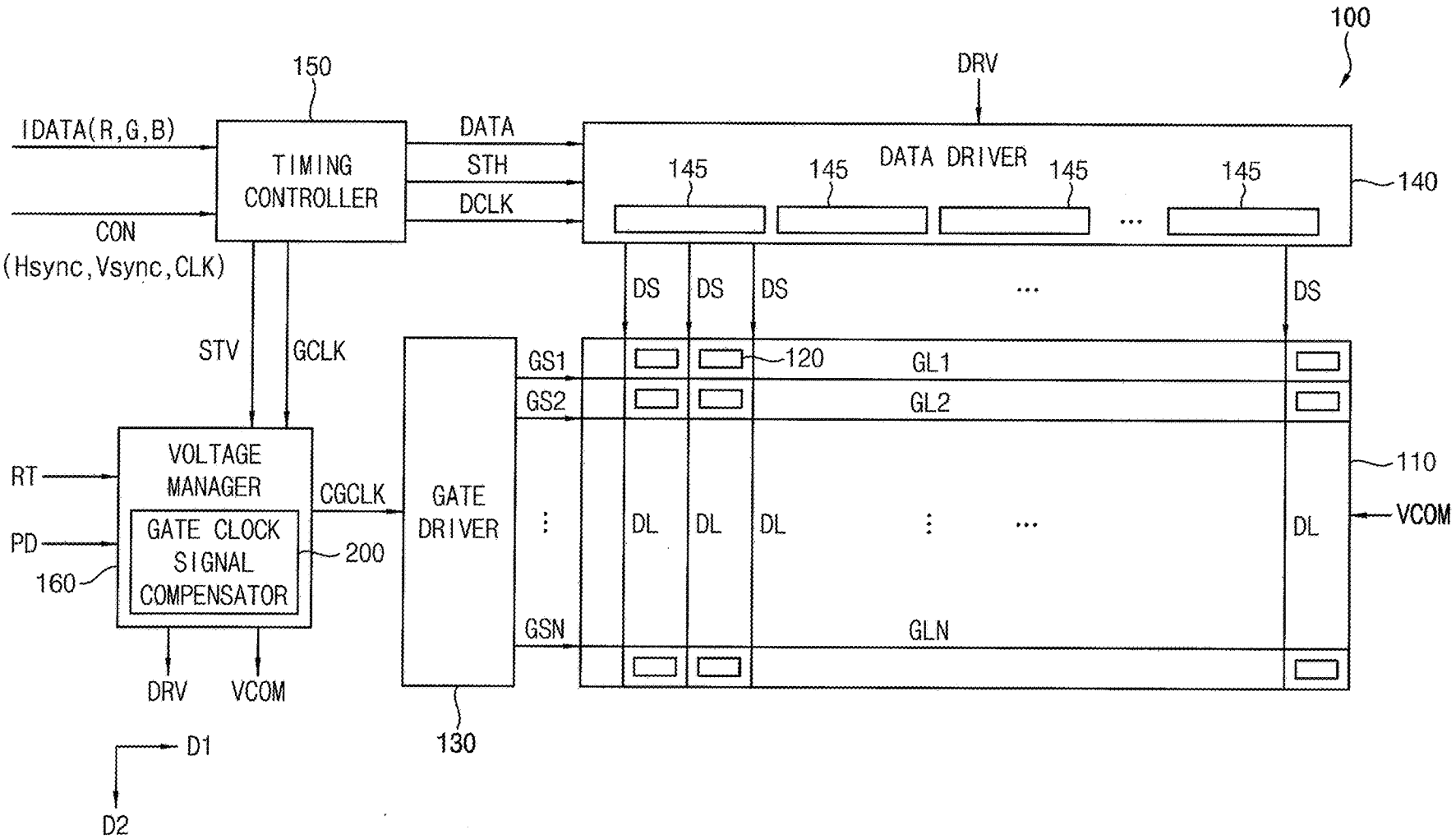
FIG. 1 is a block diagram illustrating an exemplary embodiment of a display apparatus according to the invention.

FIG. 1 is a block diagram illustrating an exemplary embodiment of a display apparatus according to the invention.

Referring to FIG. 1, the display apparatus 100 includes a display panel 110, a gate driver 130, a data driver 140, a timing controller 150 and a voltage manager 160.

The display panel 110 receives a data signal from the data driver 140 and displays an image using the data signal. The display panel 110 includes first to N-th gate lines GL1, GL2, . . . , GLN, data lines DL and pixels 120.

The first to N-th gate lines GL1, GL2, . . . , GLN extend in a first direction D1 and are arranged in a second direction D2 substantially perpendicular to the first direction D1.

The data lines DL extend in the second direction D2 and are arranged in the first direction D1.

The first direction D1 may be substantially parallel to a longer side of the display panel 110. The second direction D2 may be substantially parallel to a shorter side of the display panel 110.

The pixels 120 may be defined by the first to N-th gate lines GL1, GL2, . . . , GLN and the data lines DL which surround the pixels 120. For example, the pixel 120 may include a thin film transistor, a liquid crystal capacitor and a storage capacitor. The liquid crystal capacitor and the storage capacitor may be electrically connected to the thin film transistor. The display panel 110 may be a liquid crystal display panel including liquid crystal molecules.

The gate driver 130, the data driver 140 and the timing controller 150 may be defined as a display panel driver to drive the display panel 110.

The gate driver 130 generates first to N-th gate signals GS1, GS2, . . . , GSN based on a compensated gate clock signal CGCLK provided from the voltage manager 160. The gate driver 130 outputs the first to N-th gate signals GS1, GS2, . . . , GSN to the first to N-th gate lines GL1, GL2, . . . , GLN, respectively. The gate driver 130 may include a gate driving circuit.

The data driver 140 receives image data DATA from the timing controller 150. The data driver 140 generates the data signal DS using the image data DATA. The data driver 140 outputs the data signal DS to the data line DL in response to a horizontal start signal STH and a data clock signal DCLK. The data driver 140 may include data driving integrated circuits 145 generating the data signals DS and outputting the data signals DS to the data lines DL. In addition, the data driver 140 may output the data signal DS to the data line DL using a driving voltage DRV provided from the voltage manager 160. The data driver 140 may include a data driving circuit.

The timing controller 150 receives input image data IDATA and a control signal CON from an external apparatus. The input image data IDATA may include red data R, green data G and blue data B. The control signal CON may include a horizontal synchronizing signal Hsync, a vertical synchronizing signal Vsync and a timing clock signal CLK. The timing controller 150 processes the input image data IDATA to generate the image data DATA and outputs the image data DATA to the data driver 140. The timing controller 150 generates the horizontal start signal STH based on the horizontal synchronizing signal Hsync and outputs the horizontal start signal STH to the data driver 140. In addition, the timing controller 150 generates a vertical start signal STV based on the vertical synchronizing signal Vsync and outputs the vertical start signal STV to the voltage manager 160. In addition, the timing controller 150 generates a gate clock signal GCLK and the data clock signal DCLK based on the timing clock signal CLK. The timing controller 150 outputs the gate clock signal GCLK to the voltage manager 160 and the data clock signal DCLK to the data driver 140. The timing controller 150 may include a timing control circuit.

The voltage manager 160 outputs the driving voltage DRV to the data driver 140. In addition, when the display panel 110 is the liquid crystal display panel, the voltage manager 160 may output a common voltage VCOM to the display panel 110. The voltage manager 160 may include a power management integrated circuit ("PMIC").

The voltage manager 160 may include a gate clock signal compensator 200. The gate clock signal compensator 200 compensates a jitter of the gate clock signal GCLK and generates the compensated gate clock signal CGCLK. The gate clock signal compensator 200 outputs the compensated gate clock signal CGCLK to the gate driver 130. The gate clock signal compensator 200 receives the vertical start signal STV and the gate clock signal GCLK from the timing controller 150. The gate clock signal compensator 200 receives a reference time RT and periodic data PD from an external apparatus. The gate clock signal compensator 200 outputs the compensated gate clock signal CGCLK based on the vertical start signal STV, the gate clock signal GCLK, the reference time RT and the periodic data PD.

Figure 2:
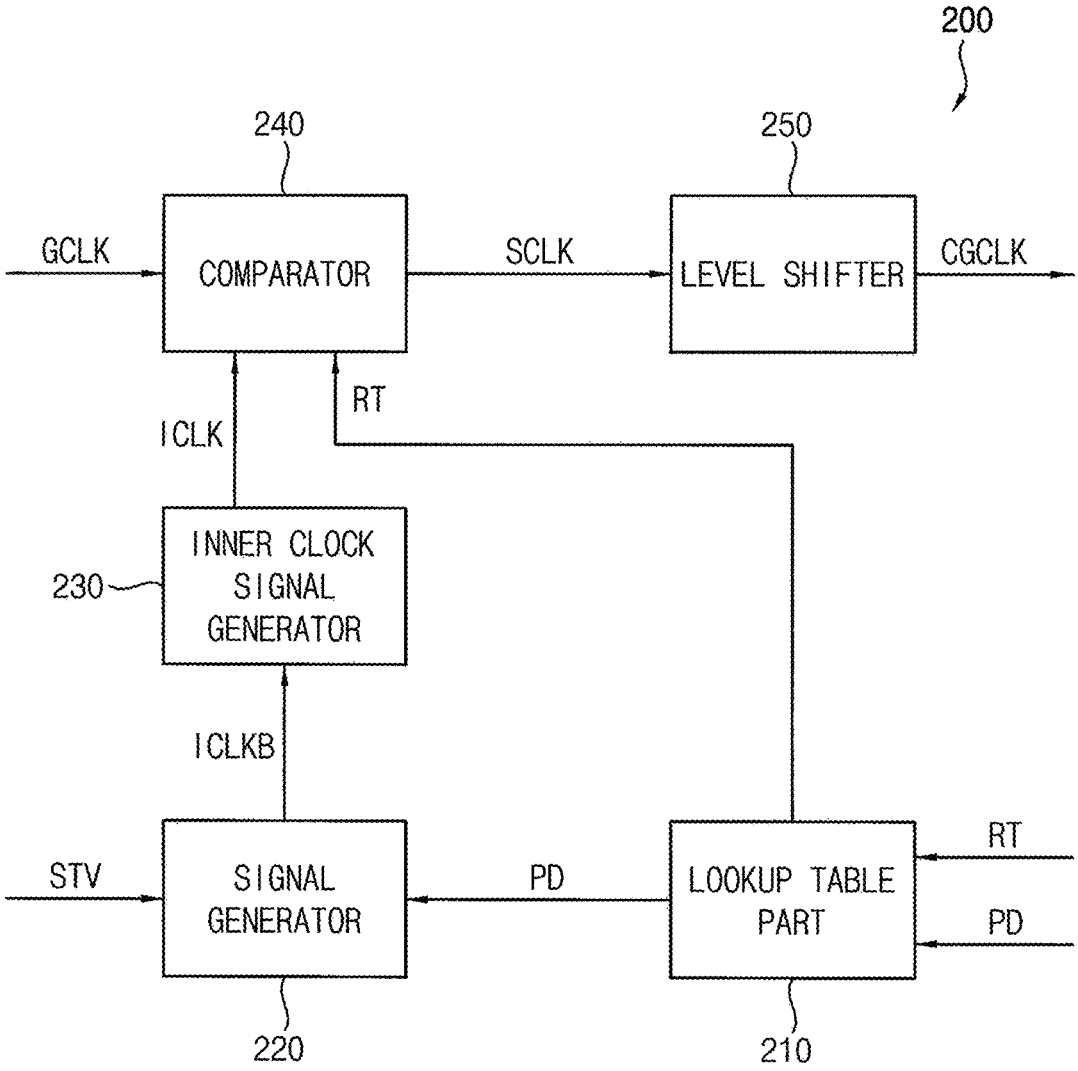
FIG. 2 is a block diagram illustrating an exemplary embodiment of a gate clock signal compensator of FIG. 1.

FIG. 2 is a block diagram illustrating an exemplary embodiment of the gate clock signal compensator 200 of FIG. 1.

Referring to FIGS. 1 and 2, the gate clock signal compensator 200 includes a lookup table part 210, a signal generator 220, an inner clock signal generator 230, a comparator 240 and a level shifter 250.

The lookup table part 210 may receive the reference time RT and the periodic data PD and stores the reference time RT and the periodic data PD. The reference time RT may represent tolerance of the jitter of the gate clock signal GCLK. The lookup table part 210 may include a memory receiving the reference time RT and the periodic data PD and storing the reference time RT and the periodic data PD.

The signal generator 220 receives the vertical start signal STV from the timing controller 150 and the periodic data PD from the lookup table part 210. The signal generator 220 generates an inner clock base signal ICLKB based on the vertical start signal STV and the periodic data PD and outputs the inner clock base signal ICLKB to the inner clock signal generator 230.

The inner clock signal generator 230 receives the inner clock base signal ICLKB from the signal generator 220. The inner clock signal generator 230 generates an inner clock signal ICLK based on the inner clock base signal ICLKB. The inner clock signal generator 230 outputs the inner clock signal ICLK to the comparator 240.

The comparator 240 receives the gate clock signal GCLK from the timing controller 150, the inner clock signal ICLK from the inner clock signal generator 230 and the reference time RT from the lookup table part 210. The comparator 240 selects one of the gate clock signal GCLK and the inner clock signal ICLK based on time difference between the gate clock signal GCLK and the inner clock signal ICLK. The comparator 240 outputs the selected one of the gate clock signal GCLK and the inner clock signal ICLK as a selected clock signal SCLK.

For example, when the time difference between the gate clock signal GCLK and the inner clock signal ICLK is equal to or greater than the reference time RT, the comparator 240 selects the inner clock signal ICLK of the gate clock signal GCLK and the inner clock signal ICLK and outputs the inner clock signal ICLK as the selected clock signal SCLK. When the time difference between the gate clock signal GCLK and the inner clock signal ICLK is less than the reference time RT, the comparator 240 selects the gate clock signal GCLK of the gate clock signal GCLK and the inner clock signal ICLK and outputs the gate clock signal GCLK as the selected clock signal SCLK.

The comparator 240 may include a first comparator (not illustrated) comparing the gate clock signal GCLK to the inner clock signal ICLK and a second comparator (not illustrated) comparing the time difference between the gate clock signal GCLK and the inner clock signal ICLK to the reference time RT.

The level shifter 250 increases a level of the selected clock signal SCLK and generates the compensated gate clock signal CGCLK as a level-increased clock signal. That is, the level shifter 250 increases a level of the inner clock signal ICLK or a level of the gate clock signal GCLK and generates the compensated gate clock signal CGCLK as a selected and level-increased signal. In an exemplary embodiment, for example, the selected clock signal SCLK inputted to the level shifter 250 may have an amplitude of about 3.3 volts and the compensated gate clock signal CGCLK outputted from the level shifter 250 may have an amplitude of about 30 volts.

Figure 3:
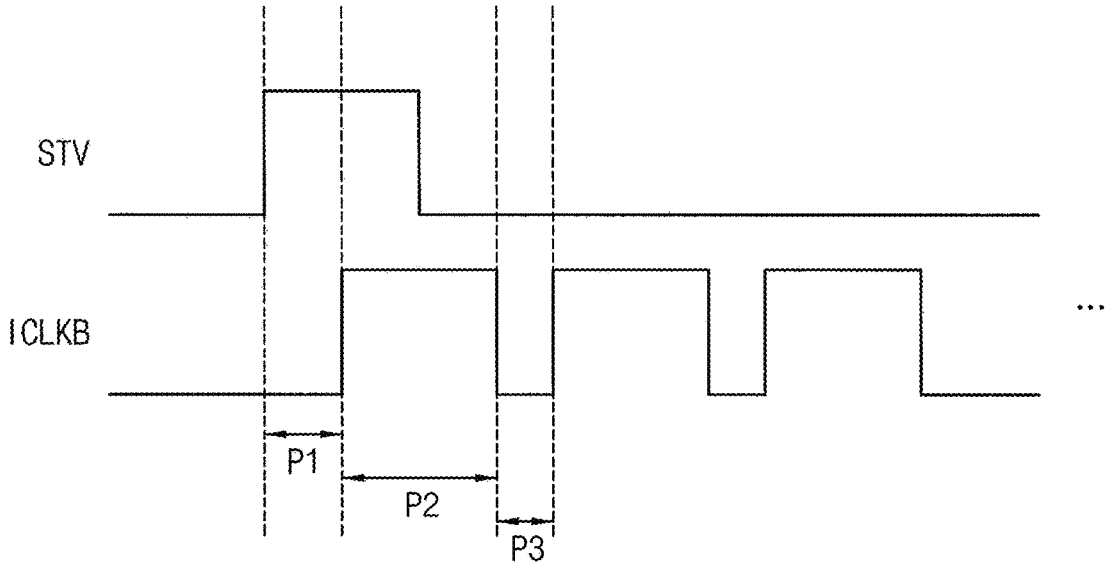
FIG. 3 is a timing diagram illustrating an exemplary embodiment of a vertical start signal and an inner clock base signal of FIG. 2.

FIG. 3 is a timing diagram illustrating an exemplary embodiment of the vertical start signal STV and the inner clock base signal ICLKB of FIG. 2.

Referring to FIGS. 1 to 3, the inner clock base signal ICLKB may include a first period P1, a second period P2 and a third period P3. The first period P1 is from a time of a rising edge of the vertical start signal STV to a time of a rising edge of the inner clock base signal ICLKB. The second period P2 is from the time of the rising edge of the inner clock base signal ICLKB to a time of a falling edge of the inner clock base signal ICLKB. The third period P3 is from the time of the falling edge of the inner clock base signal ICLKB to a time of a next rising edge of the inner clock base signal ICLKB.

Data regarding the first period P1, the second period P2 and the third period P3 of the inner clock base signal ICLKB may be included in the periodic data PD, and the first period P1, the second period P2 and the third period P3 may be set based on the gate clock signal GCLK. Thus, the signal generator 220 may generate the inner clock base signal ICLKB based on the vertical start signal STV and the periodic data PD.

Figure 4:
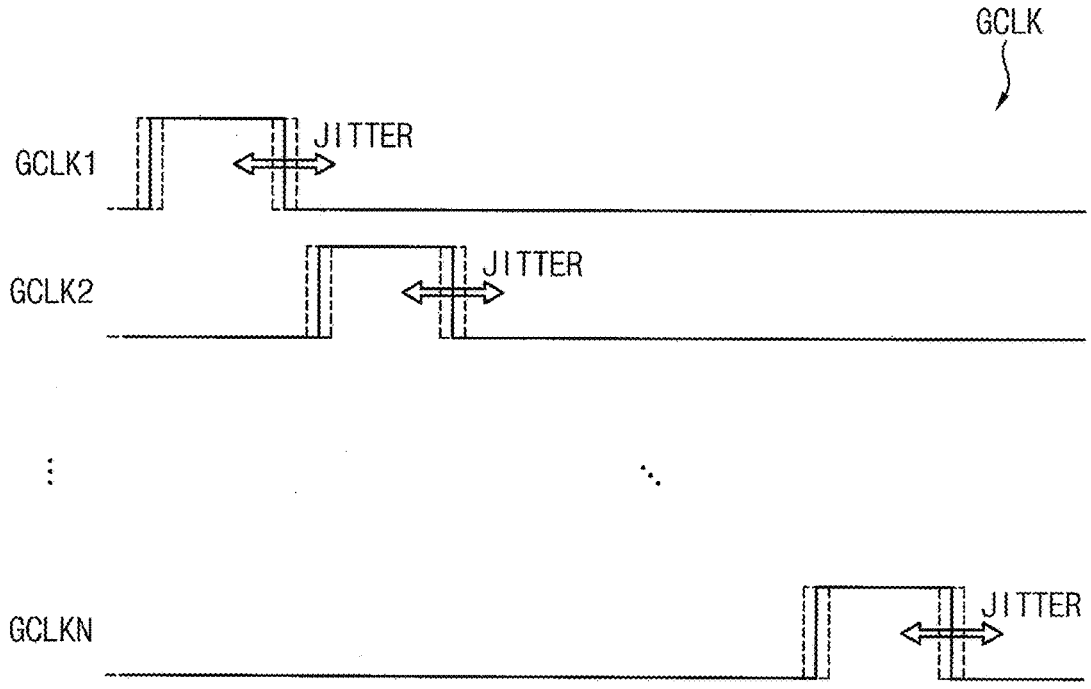
FIG. 4 is a timing diagram illustrating an exemplary embodiment of a gate clock signal of FIGS. 1 and 2.

FIG. 4 is a timing diagram illustrating an exemplary embodiment of the gate clock signal GCLK of FIGS. 1 and 2.

Referring to FIGS. 1 to 4, the gate clock signal GCLK may include first to N-th gate clock signals GCLK1, GCLK2, . . . , GCLKN for respective timings of the first to N-th gate signals GS1, GS2, . . . , GSN. Each of the first to N-th gate clock signals GCLK1, GCLK2, . . . , GCLKN may have the jitter. In an exemplary embodiment, for example, the first gate clock signal GCLK1 has time differences in frames. For example, the rising edge of the first gate clock signal GCLK1 may occur at a first time point in a first frame, at a second time point earlier than the first time point in a second frame, and at a third time point later than the first time point in a third frame.

Figure 5:
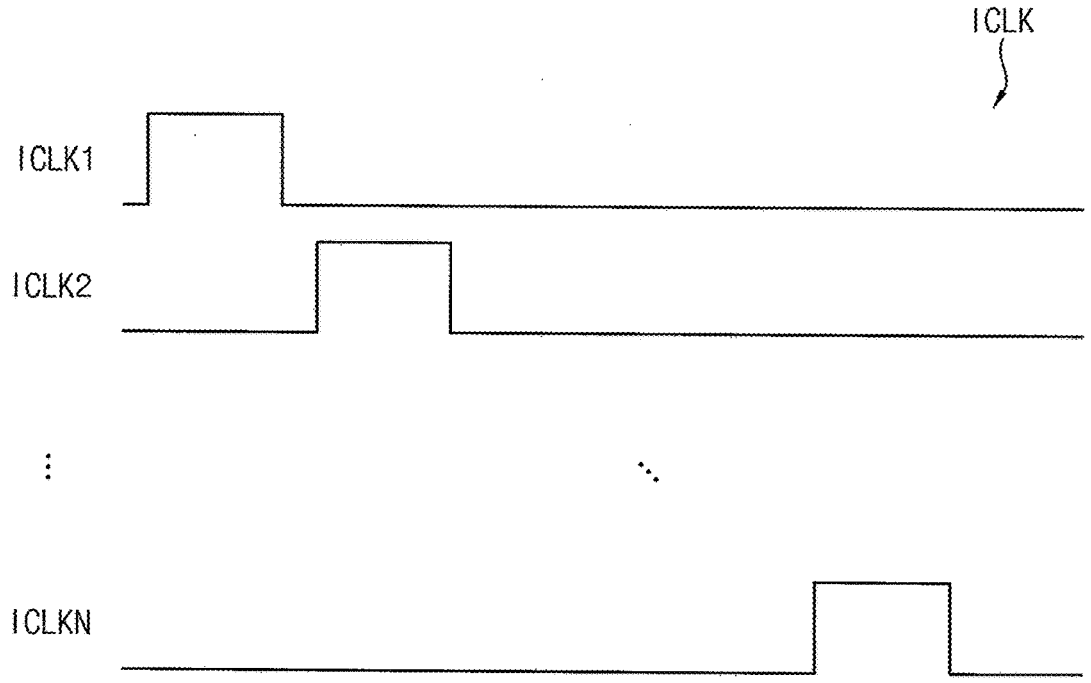
FIG. 5 is a timing diagram illustrating an exemplary embodiment of an inner clock signal of FIG. 2.

FIG. 5 is a timing diagram illustrating an exemplary embodiment of the inner clock signal ICLK of FIG. 2.

Referring to FIGS. 1 to 5, the inner clock signal ICLK includes first to N-th inner clock signals ICLK1, ICLK2, . . . , ICLKN. The first to N-th inner clock signals ICLK1, ICLK2, . . . , ICLKN do not have the jitter. The first to N-th inner clock signals ICLK1, ICLK2, . . . , ICLKN are generated based on the inner clock base signal ICLKB.

In an exemplary embodiment, for example, the first to N-th inner clock signals ICLK1, ICLK2, . . . , ICLKN may be generated in response to the rising edges of the inner clock base signal ICLKB. For example, the first inner clock signal ICLK1 may be generated in response to a first rising edge in a first cycle of the inner clock base signal ICLKB and the first inner clock signal ICLK1 may have a high level during the second period P2 in the first cycle of the inner clock base signal ICLKB. In addition, the second inner clock signal ICLK2 may be generated in response to a second rising edge in a second cycle of the inner clock base signal ICLKB and the second inner clock signal ICLK2 may have a high level during the second period P2 in the second cycle of the inner clock base signal ICLKB. In addition, the N-th inner clock signal ICLKN may be generated in response to an N-th rising edge in an N-th cycle of the inner clock base signal ICLKB and the N-th inner clock signal ICLKN may have a high level during the second period P2 in the N-th cycle of the inner clock base signal ICLKB.

Figure 6A:
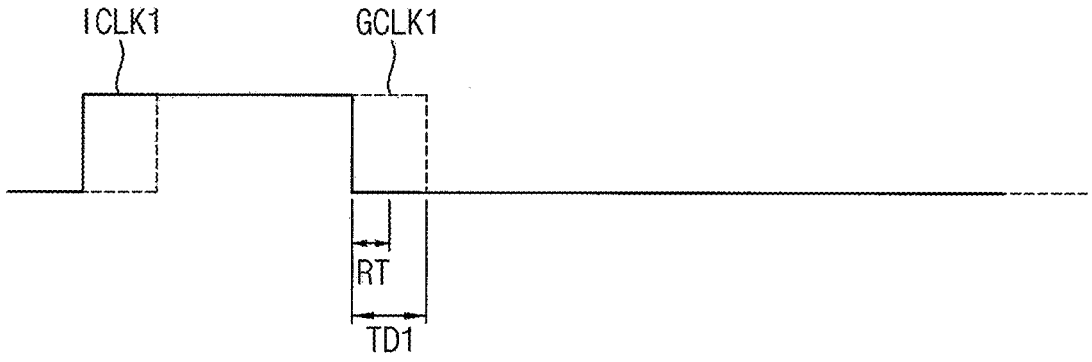
FIG. 6A is a timing diagram illustrating an exemplary embodiment of a first gate clock signal of FIG. 4 and a first inner clock signal of FIG. 5 when the time difference between the first gate clock signal and the first inner clock signal is equal to or greater than the reference time of FIGS. 1 and 2.

FIG. 6A is a timing diagram illustrating an exemplary embodiment of the first gate clock signal GCLK1 of FIG. 4 and the first inner clock signal ICLK1 of FIG. 5 when the time difference between the first gate clock signal GCLK1 and the first inner clock signal ICLK1 is equal to or greater than the reference time RT of FIGS. 1 and 2.

Referring to FIGS. 1 to 6A, the time difference TD1 between the first gate clock signal GCLK1 and the first inner clock signal ICLK1 is greater than the reference time RT.

The comparator 240 of the gate clock signal generator 200 compares the time difference TD1 between the gate clock signal GCLK and the inner clock signal ICLK to the reference time RT. When the time difference between the gate clock signal GCLK and the inner clock signal ICLK is equal to or greater than the reference time RT, the comparator 240 outputs the inner clock signal ICLK of the gate clock signal GCLK and the inner clock signal ICLK as the selected clock signal SCLK.

For example, as shown in FIG. 6A, when the time difference TD1 between the first gate clock signal GCLK1 and the first inner clock signal ICLK1 is greater than the reference time RT, the comparator 240 of the gate clock signal generator 200 outputs the first inner clock signal ICLK1 of the first gate clock signal GCLK1 and the first inner clock signal ICLK1 as the selected clock signal SCLK.

Figure 6B:
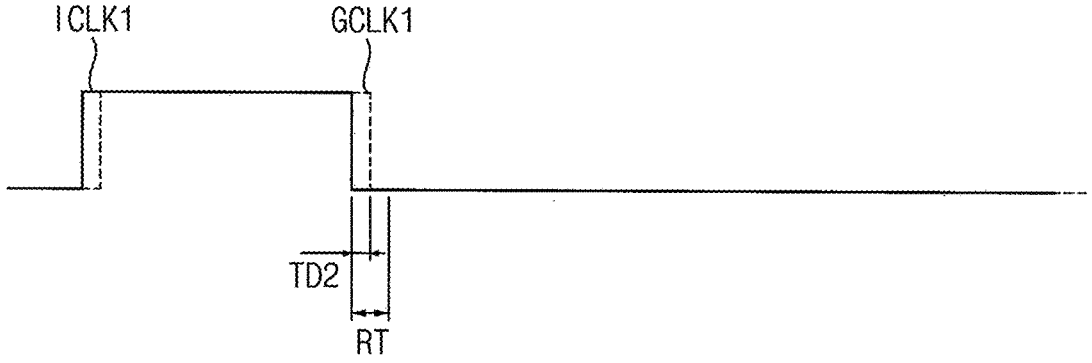
FIG. 6B is a timing diagram illustrating an exemplary embodiment of the first gate clock signal of FIG. 4 and the first inner clock signal of FIG. 5 when the time difference between the first gate clock signal and the first inner clock signal is less than the reference time of FIGS. 1 and 2.

FIG. 6B is a timing diagram illustrating an exemplary embodiment of the first gate clock signal GCLK1 of FIG. 4 and the first inner clock signal ICLK1 of FIG. 5 when the time difference between the first gate clock signal GCLK1 and the first inner clock signal ICLK1 is less than the reference time of FIGS. 1 and 2.

Referring to FIGS. 1 to 5 and 6B, the time difference TD2 between the first gate clock signal GCLK1 and the first inner clock signal ICLK1 is less than the reference time RT.

The comparator 240 of the gate clock signal generator 200 compares the time difference TD2 between the gate clock signal GCLK and the inner clock signal ICLK to the reference time RT. When the time difference TD2 between the gate clock signal GCLK and the inner clock signal ICLK is less than the reference time RT, the comparator 240 outputs the gate clock signal GCLK of the gate clock signal GCLK and the inner clock signal ICLK as the selected clock signal SCLK.

For example, as shown in FIG. 6B, when the time difference TD2 between the first gate clock signal GCLK1 and the first inner clock signal ICLK1 is greater than the reference time RT, the comparator 240 of the gate clock signal generator 200 outputs the first inner clock signal ICLK1 of the first gate clock signal GCLK1 and the first inner clock signal ICLK1 as the selected clock signal SCLK.

Figure 7:
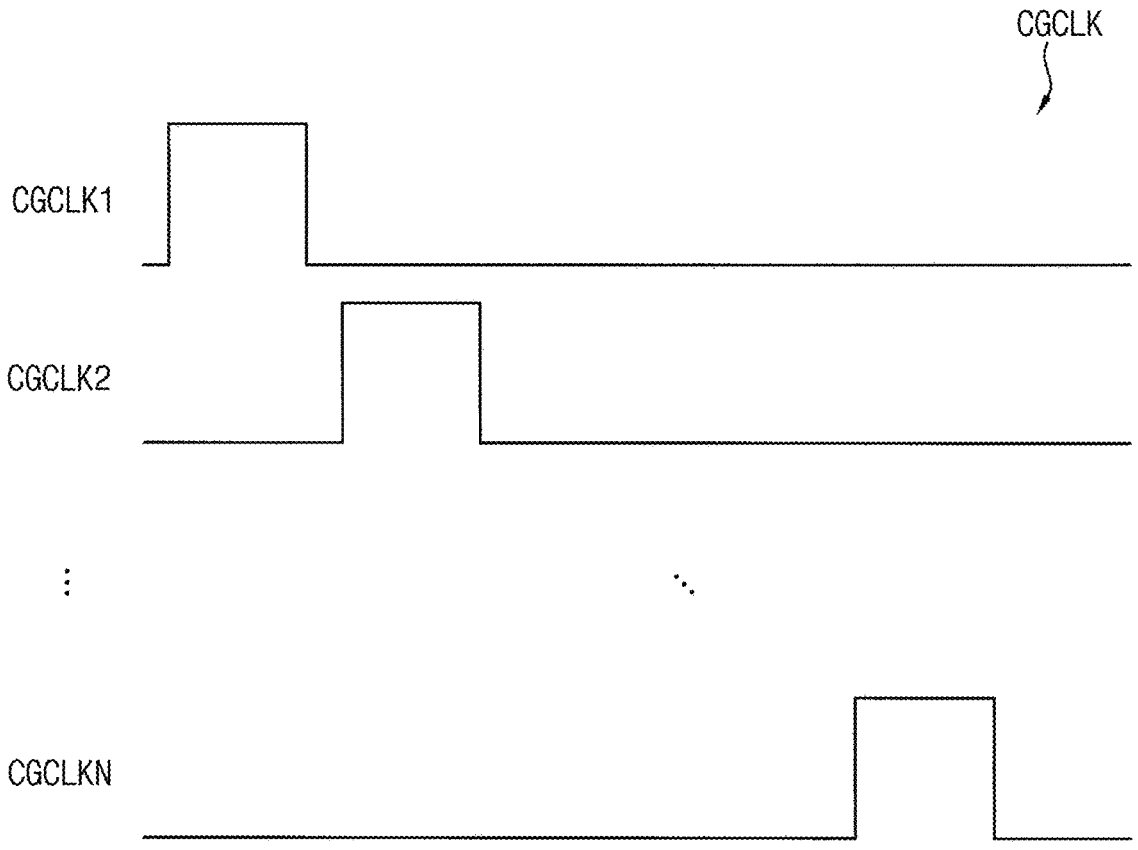
FIG. 7 is a timing diagram illustrating an exemplary embodiment of a compensated gate clock signal of FIGS. 1 and 2.

FIG. 7 is a timing diagram illustrating an exemplary embodiment of the compensated gate clock signal CGCLK of FIGS. 1 and 2.

Referring to FIGS. 1 to 7, the compensated gate clock signal CGCLK may include first to N-th compensated gate clock signals CGCLK1, CGCLK2, . . . , CGCLKN for timings of the first to N-th gate signals GS1, GS2, . . . , GSN.

The level shifter 250 increases the level of the selected clock signal SCLK and generates the compensated gate clock signal CGCLK as a level-increased clock signal. That is, the level shifter 250 increases the level of the inner clock signal ICLK or the level of the gate clock signal GCLK and generates the compensated gate clock signal CGCLK as a selected and level-increased signal. In an exemplary embodiment, for example, the selected clock signal SCLK inputted to the level shifter 250 may have the amplitude of about 3.3 volts and the compensated gate clock signal CGCLK outputted from the level shifter 250 may have the amplitude of about 30 volts.

Figure 8:
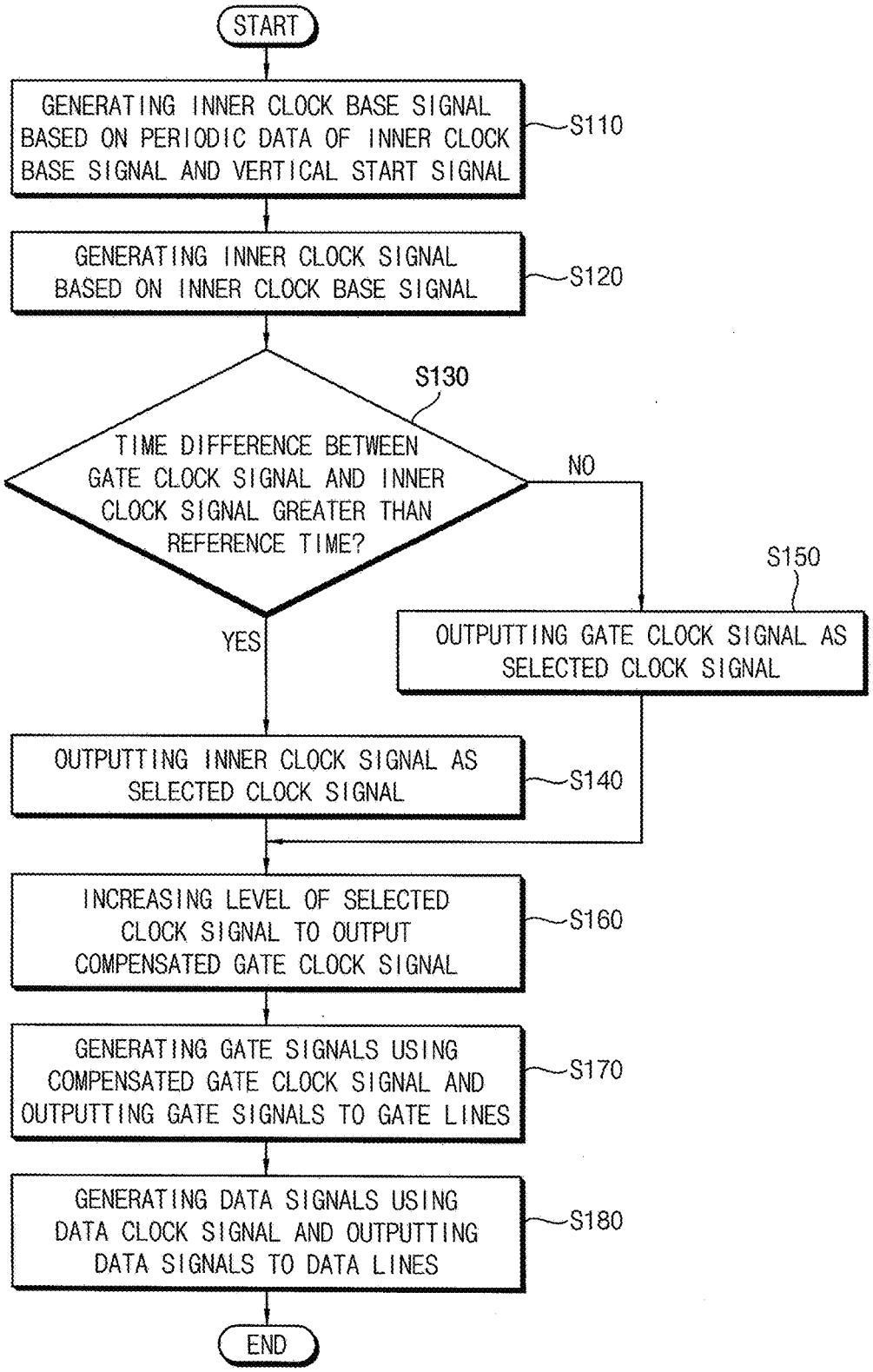
FIG. 8 is a flow chart illustrating an exemplary embodiment of a method of driving a display apparatus of FIG. 1.

FIG. 8 is a flow chart illustrating an exemplary embodiment of a method of driving the display apparatus 100 of FIG. 1.

Referring to FIGS. 1 to 8, the inner clock base signal ICLKB is generated based on the periodic data PD for the inner clock base signal ICLKB and the vertical start signal STV (S110).

In an exemplary embodiment, for example, the lookup table part 210 may receive the reference time RT and the periodic data PD and stores the reference time RT and the periodic data PD. The lookup table part 210 may include the memory receiving the reference time RT and the periodic data PD and storing the reference time RT and the periodic data PD.

The signal generator 220 receives the vertical start signal STV from the timing controller 150 and the periodic data PD from the lookup table part 210. The signal generator 220 generates the inner clock base signal ICLKB based on the vertical start signal STV and the periodic data PD and outputs the inner clock base signal ICLKB to the inner clock signal generator 230.

The inner clock base signal ICLKB may include the first period P1, the second period P2 and the third period P3. The first period P1 is from a time of the rising edge of the vertical start signal STV to a time of the rising edge of the inner clock base signal ICLKB. The second period P2 is from a time of the rising edge of the inner clock base signal ICLKB to a time of the falling edge of the inner clock base signal ICLKB. The third period P3 is from a time of the falling edge of the inner clock base signal ICLKB to a time of the next rising edge of the inner clock base signal ICLKB.

Data regarding the first period P1, the second period P2 and the third period P3 of the inner clock base signal ICLKB may be included in the periodic data PD, and the first period P1, the second period P2 and the third period P3 may be set based on the gate clock signal GCLK. Thus, the signal generator 220 may generate the inner clock base signal ICLKB based on the vertical start signal STV and the periodic data PD.

The inner clock signal ICLK is generated based on the inner clock base signal ICLKB (S120).

The inner clock signal generator 230 receives the inner clock base signal ICLKB from the signal generator 220. The inner clock signal generator 230 generates the inner clock signal ICLK based on the inner clock base signal ICLKB. The inner clock signal generator 230 outputs the inner clock signal ICLK to the comparator 240.

The inner clock signal ICLK includes first to N-th inner clock signals ICLK1, ICLK2, . . . , ICLKN. The first to N-th inner clock signals ICLK1, ICLK2, . . . , ICLKN do not have the jitter. The first to N-th inner clock signals ICLK1, ICLK2, . . . , ICLKN are generated based on the inner clock base signal ICLKB.

In an exemplary embodiment, for example, the first to N-th inner clock signals ICLK1, ICLK2, . . . , ICLKN may be generated in response to the rising edges of the inner clock base signal ICLKB. For example, the first inner clock signal ICLK1 may be generated in response to the first rising edge in the first cycle of the inner clock base signal ICLKB and the first inner clock signal ICLK1 may have a high level during the second period P2 in the first cycle of the inner clock base signal ICLKB. In addition, the second inner clock signal ICLK2 may be generated in response to the second rising edge in the second cycle of the inner clock base signal ICLKB and the second inner clock signal ICLK2 may have a high level during the second period P2 in the second cycle of the inner clock base signal ICLKB. In addition, the N-th inner clock signal ICLKN may be generated in response to the N-th rising edge in the N-th cycle of the inner clock base signal ICLKB and the N-th inner clock signal ICLKN may have a high level during the second period P2 in the N-th cycle of the inner clock base signal ICLKB.

The comparator 240 determines whether the time difference between the gate clock signal GCLK and the inner clock signal ICLK is equal to or greater than the reference time RT (S130).

The comparator 240 receives the gate clock signal GCLK from the timing controller 150, the inner clock signal ICLK from the inner clock signal generator 230 and the reference time RT from the lookup table part 210. The comparator 240 selects one of the gate clock signal GCLK and the inner clock signal ICLK based on the time difference between the gate clock signal GCLK and the inner clock signal ICLK. The comparator 240 outputs the selected one of the gate clock signal GCLK and the inner clock signal ICLK as the selected clock signal SCLK.

The comparator 240 may include the first comparator comparing the gate clock signal GCLK to the inner clock signal ICLK and the second comparator comparing the time difference between the gate clock signal GCLK and the inner clock signal ICLK to the reference time RT.

When the time difference between the gate clock signal GCLK and the inner clock signal ICLK is equal to or greater than the reference time RT, the inner clock signal ICLK is selected and outputted as the selected clock signal SCLK (S140).

For example, when the time difference between the gate clock signal GCLK and the inner clock signal ICLK is equal to or greater than the reference time RT, the comparator 240 selects the inner clock signal ICLK of the gate clock signal GCLK and the inner clock signal ICLK and outputs the inner clock signal ICLK as the selected clock signal SCLK.

When the time difference between the gate clock signal GCLK and the inner clock signal ICLK is less than the reference time RT, the gate clock signal GCLK is selected and outputted as the selected clock signal SCLK (S150).

For example, when the time difference between the gate clock signal GCLK and the inner clock signal ICLK is less than the reference time RT, the comparator 240 selects the gate clock signal GCLK of the gate clock signal GCLK and the inner clock signal ICLK and outputs the gate clock signal GCLK as the selected clock signal SCLK.

The level of the selected clock signal SCLK is increased and the increased clock signal is outputted as the compensated gate clock signal CGCLK (S160).

For example, the level shifter 250 increases the level of the selected clock signal SCLK and generates the increased clock signal as the compensated gate clock signal CGCLK. The level shifter 250 increases the level of the inner clock signal ICLK or the level of the gate clock signal GCLK and generates the selected and level-increased signal as the compensated gate clock signal CGCLK. In an exemplary embodiment, for example, the selected clock signal SCLK inputted to the level shifter 250 may have an amplitude of about 3.3 volts and the compensated gate clock signal CGCLK outputted from the level shifter 250 may have an amplitude of about 30 volts.

The first to N-th gate signals GS1, GS2, . . . , GSN are generated based on the compensated gate clock signal CGCLK and the first to N-th gate signals GS1, GS2, . . . , GSN are outputted to the first to N-th gate lines GL1, GL2, . . . , GLN, respectively (S170).

The gate driver 130 generates first to N-th gate signals GS1, GS2, . . . , GSN based on a compensated gate clock signal CGCLK provided from the voltage manager 160. The gate driver 130 outputs the first to N-th gate signals GS1, GS2, . . . , GSN to the first to N-th gate lines GL1, GL2, . . . , GLN, respectively. The gate driver 130 may include the gate driving circuit.

The data signals DS are generated based on the data clock signal DCLK and the data signals DS are outputted to the data lines DL (S180).

The data driver 140 receives image data DATA from the timing controller 150. The data driver 140 generates the data signal DS based on the image data DATA. The data driver 140 outputs the data signal DS to the data line DL in response to the horizontal start signal STH and the data clock signal DCLK. The data driver 140 may include data driving integrated circuits 145 generating the data signals DS and outputting the data signals DS to the data lines DL. In addition, the data driver 140 may output the data signal DS to the data line DL based on the driving voltage DRV provided from the voltage manager 160. The data driver 140 may include the data driving circuit.

Although the gate clock signal compensator 200 is included in the voltage manager 160 in the above exemplary embodiments, the invention is not limited thereto. Alternatively, the gate clock signal compensator 200 may be disposed out of the voltage manager 160.

In addition, in an alternative exemplary embodiment, the inner clock signal ICLK may be called a clock signal, the inner clock base signal ICLKB may be called a clock base signal, and the inner clock signal generator 230 generating and outputting the inner clock signal ICLK may be called a clock signal generator.

According to an exemplary embodiment, the gate clock signal compensator 200 may compensate the jitter of the gate clock signal GCLK to generate the compensated gate clock signal CGCLK. The gate driver 130 generates the first to N-th gate signals GS1, GS2, . . . , GSN based on the compensated gate clock signal CGCLK that the jitter of the gate clock signal GCLK is compensated. Thus, the horizontal line defect of the image displayed on the display panel 110 due to the jitter may be effectively prevented. Therefore, the display quality of the display apparatus 100 may be enhanced.

Exemplary Embodiment 2

Figure 9:
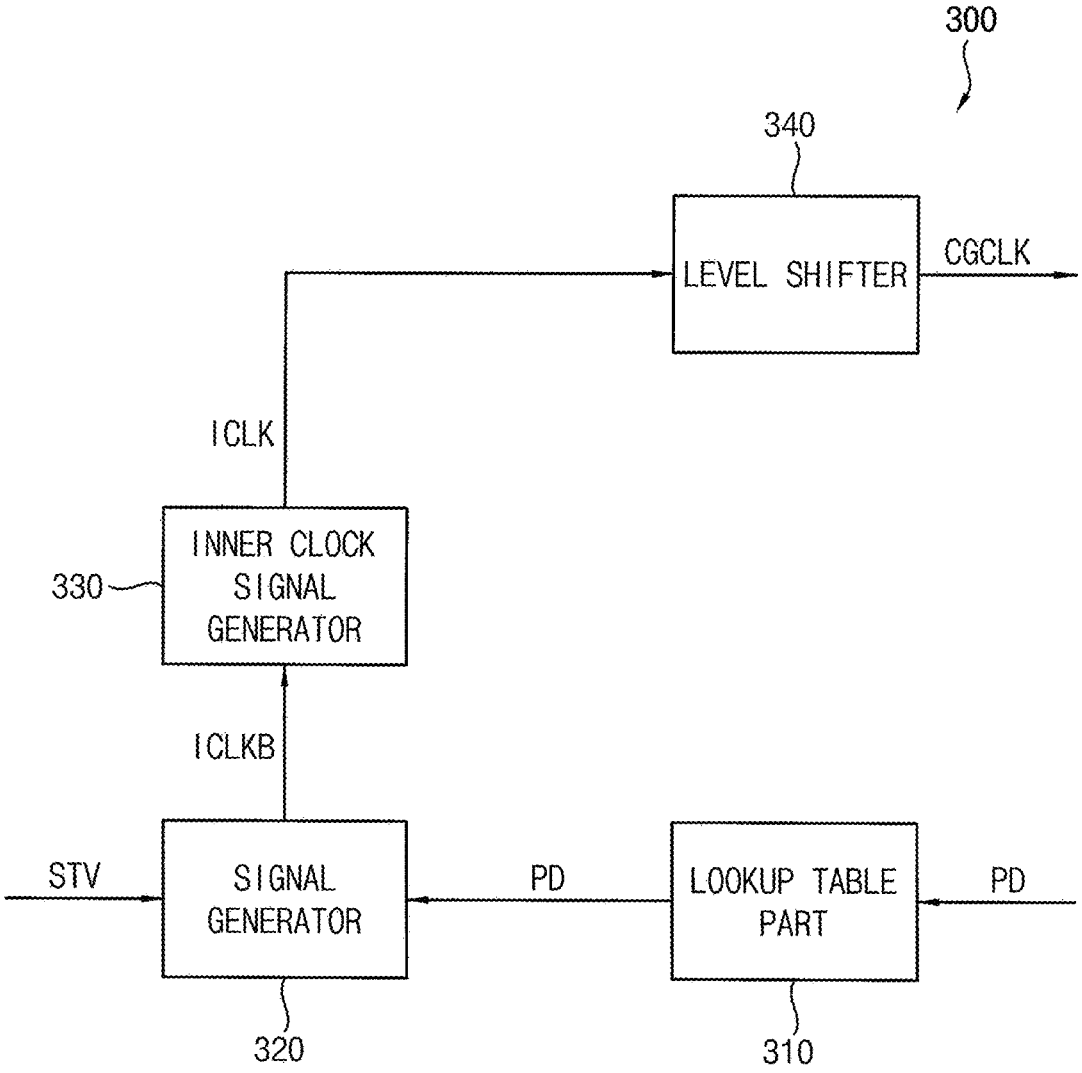
FIG. 9 is a block diagram illustrating another exemplary embodiment of a gate clock signal compensator according to the invention.

FIG. 9 is a block diagram illustrating an exemplary embodiment of a gate clock signal compensator 300 according to the invention.

The gate clock signal compensator 300 of this exemplary embodiment shown in FIG. 9 may be included in the voltage manager 160 of the display apparatus 100 shown in FIG. 1 instead of the gate clock signal compensator 200. The display apparatus including the gate clock signal compensator 300 according to this exemplary embodiment is substantially the same as the display apparatus 100 of the previous exemplary embodiments explained referring to FIGS. 1 to 8 except for the gate clock signal compensator 300. Thus, the same reference numerals will be used to refer to the same or like parts as those described in the previous exemplary embodiment of FIGS. 1 to 8 and any repetitive explanation concerning the above elements will be omitted.

Referring to FIGS. 1 and 9, the gate clock signal compensator 300 includes a lookup table part 310, a signal generator 320, an inner clock signal generator 300 and a level shifter 340.

The lookup table part 310 may receive the periodic data PD and stores the periodic data PD. The lookup table part 310 may include a memory receiving the periodic data PD and storing the periodic data PD.

The signal generator 320 receives the vertical start signal STV from the timing controller 150 and the periodic data PD from the lookup table part 310. The signal generator 320 generates the inner clock base signal ICLKB based on the vertical start signal STV and the periodic data PD and outputs the inner clock base signal ICLKB to the inner clock signal generator 330.

The inner clock signal generator 330 receives the inner clock base signal ICLKB from the signal generator 320. The inner clock signal generator 330 generates an inner clock signal ICLK based on the inner clock base signal ICLKB. The inner clock signal generator 330 outputs the inner clock signal ICLK to the level shifter 340.

The level shifter 340 increases a level of the inner clock signal ICLK and generates the level-increased clock signal as the compensated gate clock signal CGCLK. In an exemplary embodiment, for example, the inner clock signal ICLK inputted to the level shifter 340 may have an amplitude of about 3.3 volts and the compensated gate clock signal CGCLK outputted from the level shifter 340 may have an amplitude of about 30 volts.

Figure 10:
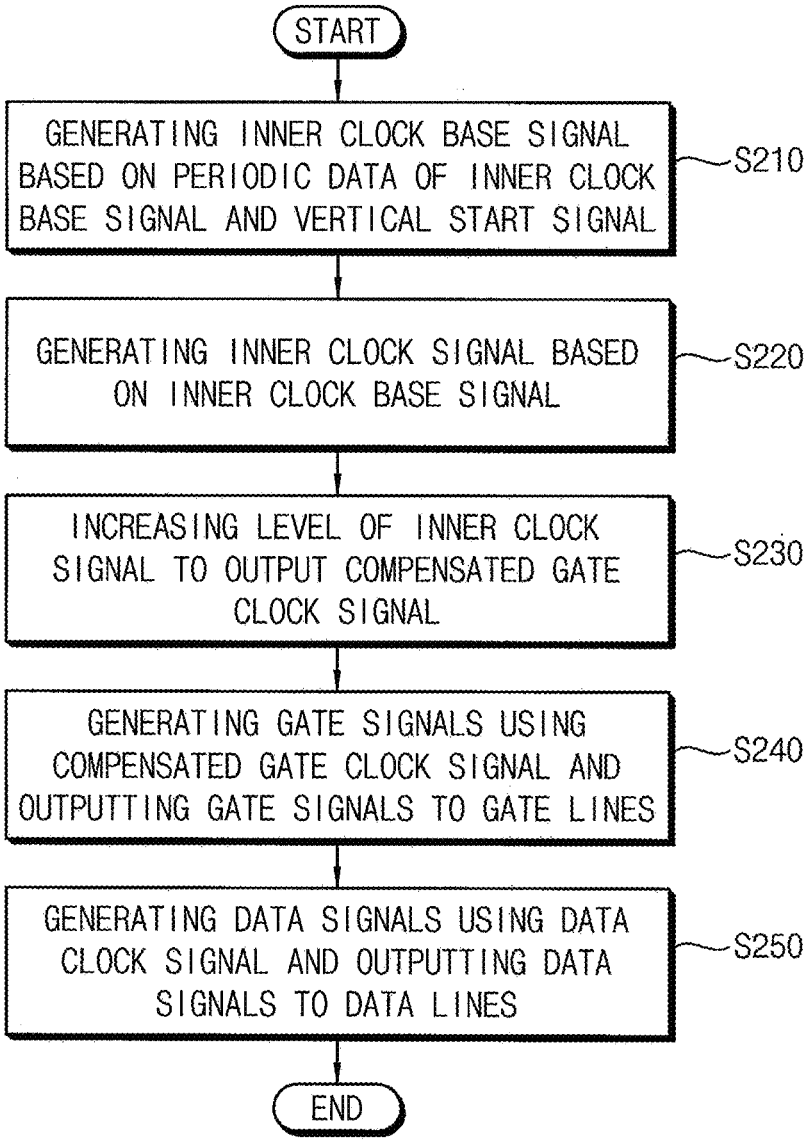
FIG. 10 is a flow chart illustrating an exemplary embodiment of a method of driving a display apparatus including the gate clock signal compensator of FIG. 9.

FIG. 10 is a flow chart illustrating an exemplary embodiment of a method of driving the display apparatus 100 including the gate clock signal compensator 300 of FIG. 9.

Referring to FIGS. 1, 3 to 5, 7, 9 and 10, the inner clock base signal ICLKB is generated based on the periodic data PD for the inner clock base signal ICLKB and the vertical start signal STV (S210).

In an exemplary embodiment, for example, the lookup table part 310 may receive the periodic data PD and stores the periodic data PD. The lookup table part 310 may include the memory receiving the periodic data PD and storing the periodic data PD.

The signal generator 320 receives the vertical start signal STV from the timing controller 150 and the periodic data PD from the lookup table part 310. The signal generator 320 generates the inner clock base signal ICLKB based on the vertical start signal STV and the periodic data PD and outputs the inner clock base signal ICLKB to the inner clock signal generator 330.

The inner clock base signal ICLKB may include the first period P1, the second period P2 and the third period P3. The first period P1 is from a time of the rising edge of the vertical start signal STV to a time of the rising edge of the inner clock base signal ICLKB. The second period P2 is from a time of the rising edge of the inner clock base signal ICLKB to a time of the falling edge of the inner clock base signal ICLKB. The third period P3 is from a time of the falling edge of the inner clock base signal ICLKB to a time of the next rising edge of the inner clock base signal ICLKB.

Data regarding the first period P1, the second period P2 and the third period P3 of the inner clock base signal ICLKB may be included in the periodic data PD, and the first period P1, the second period P2 and the third period P3 may be set based on the gate clock signal GCLK. Thus, the signal generator 320 may generate the inner clock base signal ICLKB based on the vertical start signal STV and the periodic data PD.

The inner clock signal ICLK is generated based on the inner clock base signal ICLKB (S220).

The inner clock signal generator 330 receives the inner clock base signal ICLKB from the signal generator 320. The inner clock signal generator 330 generates the inner clock signal ICLK based on the inner clock base signal ICLKB. The inner clock signal generator 330 outputs the inner clock signal ICLK to the level shifter 340.

The inner clock signal ICLK includes first to N-th inner clock signals ICLK1, ICLK2, . . . , ICLKN. The first to N-th inner clock signals ICLK1, ICLK2, . . . , ICLKN do not have the jitter. The first to N-th inner clock signals ICLK1, ICLK2, . . . , ICLKN are generated based on the inner clock base signal ICLKB.

In an exemplary embodiment, for example, the first to N-th inner clock signals ICLK1, ICLK2, . . . , ICLKN may be generated in response to the rising edges of the inner clock base signal ICLKB. For example, the first inner clock signal ICLK1 may be generated in response to the first rising edge in the first cycle of the inner clock base signal ICLKB and the first inner clock signal ICLK1 may have a high level during the second period P2 in the first cycle of the inner clock base signal ICLKB. In addition, the second inner clock signal ICLK2 may be generated in response to the second rising edge in the second cycle of the inner clock base signal ICLKB and the second inner clock signal ICLK2 may have a high level during the second period P2 in the second cycle of the inner clock base signal ICLKB. In addition, the N-th inner clock signal ICLKN may be generated in response to the N-th rising edge in the N-th cycle of the inner clock base signal ICLKB and the N-th inner clock signal ICLKN may have a high level during the second period P2 in the N-th cycle of the inner clock base signal ICLKB.

The level of the inner clock signal ICLK is increased and the increased clock signal is outputted as the compensated gate clock signal CGCLK (S230).

For example, the level shifter 340 increases the level of the inner clock signal ICLK and generates the level-increased signal as the compensated gate clock signal CGCLK. In an exemplary embodiment, for example, the inner clock signal ICLK inputted to the level shifter 340 may have the amplitude of about 3.3 volts and the compensated gate clock signal CGCLK outputted from the level shifter 340 may have the amplitude of about 30 volts.

The first to N-th gate signals GS1, GS2, . . . , GSN are generated based on the compensated gate clock signal CGCLK and the first to N-th gate signals GS1, GS2, . . . , GSN are outputted to the first to N-th gate lines GL1, GL2, . . . , GLN, respectively (S240).

The gate driver 130 generates first to N-th gate signals GS1, GS2, . . . , GSN based on a compensated gate clock signal CGCLK provided from the voltage manager 160. The gate driver 130 outputs the first to N-th gate signals GS1, GS2, . . . , GSN to the first to N-th gate lines GL1, GL2, . . . , GLN, respectively. The gate driver 130 may include the gate driving circuit.

The data signals DS are generated based on the data clock signal DCLK and the data signals DS are outputted to the data lines DL (S250).

The data driver 140 receives image data DATA from the timing controller 150. The data driver 140 generates the data signal DS based on the image data DATA. The data driver 140 outputs the data signal DS to the data line DL in response to the horizontal start signal STH and the data clock signal DCLK. The data driver 140 may include data driving integrated circuits 145 generating the data signals DS and outputting the data signals DS to the data lines DL. In addition, the data driver 140 may output the data signal DS to the data line DL based on the driving voltage DRV provided from the voltage manager 160. The data driver 140 may include the data driving circuit.

Although the gate clock signal compensator 300 is included in the voltage manager 160 in the above exemplary embodiment, the invention is not limited thereto. Alternatively, the gate clock signal compensator 300 may be disposed out of the voltage manager 160.

In addition, in an alternative exemplary embodiment, the inner clock signal ICLK may be called a clock signal, the inner clock base signal ICLKB may be called a clock base signal and the inner clock signal generator 330 generating and outputting the inner clock signal ICLK may be called a clock signal generator.

According to an exemplary embodiment, the gate clock signal compensator 300 may compensate the jitter of the gate clock signal GCLK to generate the compensated gate clock signal CGCLK. The gate driver 130 generates the first to N-th gate signals GS1, GS2, . . . , GSN based on the compensated gate clock signal CGCLK that the jitter of the gate clock signal GCLK is compensated. Thus, the horizontal line defect of the image displayed on the display panel 110 due to the jitter may be effectively prevented. Therefore, the display quality of the display apparatus 100 may be enhanced.

The invention may be applied to most of electronic devices having a display unit. For example, the display apparatus according to the invention may be applied to a television, a monitor, a laptop computer, a digital camera, a cellular phone, a smart phone, a tablet PC, a smart pad, a PDA, a PMP, an MP3 player, a navigation system, a camcorder and a portable game terminal.

The foregoing is illustrative of the invention and is not to be construed as limiting thereof. Although a few exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A display apparatus comprising:

a display panel which displays an image and includes a gate line and a data line;

a gate driver which outputs a gate signal to the gate line;

a data driver which outputs a data signal to the data line;

a timing controller which outputs a vertical start signal and a gate clock signal; and a gate clock signal compensator which generates an inner clock signal based on the vertical start signal, selects one of the gate clock signal and the inner clock signal based on a comparison result of a time difference between the gate clock signal and the inner clock signal and a reference time which corresponds to tolerance of jitter of the gate clock signal, increases a voltage level of the selected one of the gate clock signal and the inner clock signal, and outputs the increased one of the gate clock signal and the inner clock signal to the gate driver as a compensated gate clock signal, wherein the gate driver generates the gate signal based on the compensated gate clock signal, wherein the gate clock signal compensator comprises a lookup table part which stores periodic data for an inner clock base signal which is a base signal of the inner clock signal, wherein the gate clock signal compensator further comprises a signal generator which generates the inner clock base signal based on the vertical start signal and the periodic data for the inner clock base signal, and wherein the periodic data for the inner clock base signal includes data regarding a first period, a second period and a third period, the first period is from a time of a rising edge of the vertical start signal to a time of a rising edge of the inner clock base signal, the second period is from a time of the rising edge of the inner clock base signal to a time of a falling edge of the inner clock base signal, and the third period is from a time of the falling edge of the inner clock base signal to a time of a next rising edge of the inner clock base signal.

2. The display apparatus of claim 1, wherein when the time difference between the gate clock signal and the inner clock signal is equal to or greater than the reference time, the gate clock signal compensator selects the inner clock signal of the gate clock signal and the inner clock signal.

3. The display apparatus of claim 2, wherein the lookup table part stores the reference time.

4. The display apparatus of claim 1, wherein the gate clock signal compensator comprises a clock signal generator which generates the inner clock signal in response to a rising edge of the inner clock base signal.

5. The display apparatus of claim 1, wherein the gate clock signal compensator comprises a comparator which compares the gate clock signal and the inner clock signal, and compares the time difference between the gate clock signal and the inner clock signal to the reference time.

6. The display apparatus of claim 1, wherein when the time difference between the gate clock signal and the inner clock signal is less than the reference time, the gate clock signal compensator selects the gate clock signal of the gate clock signal and the inner clock signal.

7. The display apparatus of claim 1, further comprising a voltage manager which outputs a driving voltage to the data driver, wherein the gate clock signal compensator is included in the voltage manager.

8. The display apparatus of claim 7, wherein the display panel is a liquid crystal display panel including a liquid crystal layer, and the voltage manager outputs a common voltage to the display panel.

9. A display apparatus comprising:

a display panel which displays an image and includes a gate line and a data line;

a gate driver which outputs a gate signal to the gate line;

a data driver which outputs a data signal to the data line;

a timing controller which outputs a vertical start signal; and a gate clock signal compensator which generates an inner clock signal based on the vertical start signal, increases a voltage level of the inner clock signal, and outputs the increased clock signal to the gate driver as a compensated gate clock signal, wherein the gate driver generates the gate signal based on the compensated gate clock signal, wherein the gate clock signal compensator comprises a lookup table part which stores periodic data for an inner clock base signal which is a base signal of the inner clock signal, wherein the gate clock signal compensator further comprises a signal generator which generates the inner clock base signal based on the vertical start signal and the periodic data for the inner clock base signal, and wherein the periodic data for the inner clock base signal includes data regarding a first period, a second period and a third period, the first period is from a time of a rising edge of the vertical start signal to a time of a rising edge of the inner clock base signal, the second period is from a time of the rising edge of the inner clock base signal to a time of a falling edge of the inner clock base signal, and the third period is from a time of the falling edge of the inner clock base signal to a time of a next rising edge of the inner clock base signal.

10. The display apparatus of claim 9, wherein the gate clock signal compensator comprises a clock signal generator which generates the inner clock signal in response to a rising edge of the inner clock base signal.

11. The display apparatus of claim 9, further comprising a voltage manager which outputs a driving voltage to the data driver, wherein the gate clock signal compensator is included in the voltage manager.

12. The display apparatus of claim 11, wherein the display panel is a liquid crystal display panel including a liquid crystal layer, and the voltage manager outputs a common voltage to the display panel.

13. A method of driving a display apparatus, the method comprising:

generating an inner clock base signal based on a vertical start signal and periodic data for the inner clock base signal;

generating an inner clock signal based on the inner clock base signal;

determining whether a time difference between a gate clock signal and the inner clock signal is equal to or greater than a reference time which corresponds to tolerance of jitter of the gate clock signal;

selecting the inner clock signal of the gate clock signal and the inner clock signal as a selected clock signal when the time difference between the gate clock signal and the inner clock signal is equal to or greater than the reference time;

selecting the gate clock signal of the gate clock signal and the inner clock signal as the selected clock signal when the time difference between the gate clock signal and the inner clock signal is less than the reference time;

increasing a voltage level of the selected clock signal;

providing the selected clock signal having the increased voltage level as a compensated gate clock signal;

generating a gate signal based on the compensated gate clock signal;

providing the gate signal to a gate line of a display panel;

providing a data signal to a data line of the display panel;

storing periodic data for an inner clock base signal, wherein the periodic data for the inner clock base signal includes data regarding a first period, a second period and a third period, the first period is from a time of a rising edge of the vertical start signal to a time of a rising edge of the inner clock base signal, the second period is from a time of the rising edge of the inner clock base signal to a time of a falling edge of the inner clock base signal, and the third period is from a time of the falling edge of the inner clock base signal to a time of a next rising edge of the inner clock base signal.

* * * * *